United States Patent [19]

Mizuno

[11] Patent Number: 4,722,661

[45] Date of Patent: Feb. 2, 1988

[54] MAGNETIC-DRIVE CENTRIFUGAL PUMP

[75] Inventor: Motoshige Mizuno, Tokai, Japan

[73] Assignee: NGK Insulators, Ltd., Aichi, Japan

[21] Appl. No.: 785,657

[22] Filed: Oct. 9, 1985

[51] Int. Cl.[4] ..... F01D 25/24

[52] U.S. Cl. ..... 415/131; 417/360; 417/420; 310/106

[58] Field of Search ..... 415/129, 131, 132, 201, 415/206, 200; 417/360, 420; 310/106

[56] References Cited

U.S. PATENT DOCUMENTS

| | | | |
|---|---|---|---|
| 3,045,134 | 7/1962 | Mould, Jr. | 310/106 |
| 3,149,574 | 9/1964 | Mill | 415/200 |
| 3,184,218 | 5/1965 | Hochwalt et al. | 415/129 |
| 3,280,748 | 10/1966 | Ogles | 415/132 |
| 3,398,695 | 8/1968 | Pritz | 415/127 |
| 3,411,450 | 11/1968 | Clifton | 417/420 |
| 3,877,844 | 4/1975 | Klaus et al. | 417/420 |
| 4,065,234 | 12/1977 | Yoshiyuki et al. | 464/29 X |
| 4,115,040 | 9/1978 | Knorr | 464/29 X |
| 4,184,090 | 1/1980 | Taiani et al. | 310/104 |
| 4,197,474 | 4/1980 | Honigsbaum | 310/104 |
| 4,207,485 | 6/1980 | Silver | 417/420 X |
| 4,277,707 | 7/1981 | Silver et al. | 417/420 X |
| 4,336,339 | 6/1982 | Okumiya et al. | 501/104 X |
| 4,439,096 | 3/1984 | Rockwood et al. | 415/132 |
| 4,525,464 | 6/1985 | Claussen et al. | 501/104 X |
| 4,585,499 | 4/1986 | Mase et al. | 501/103 X |

FOREIGN PATENT DOCUMENTS

| | | |
|---|---|---|
| 3337086 | 5/1985 | Fed. Rep. of Germany . |
| 2073021 | 9/1971 | France . |
| 59-180099 | 10/1984 | Japan . |

*Primary Examiner*—Abraham Hershkovitz
*Assistant Examiner*—John T. Kwon
*Attorney, Agent, or Firm*—Parkhurst & Oliff

[57] ABSTRACT

A magnetic-drive centrifugal pump comprises a driving motor, a pump shaft, an impeller, a rotor with a sleeve portion to which is connected the impeller, the rotor and impeller being rotatably mounted on the pump shaft, and a pump casing consisting of a front casing and a rear casing. The impeller is driven by a magnetic coupling formed by a driving magnet provided on a magnet holder connected to the driving motor and an impeller magnet provided in the rotor. The sleeve portion has an outer diameter smaller than an outer diameter of a main portion of the rotor. The rear casing has at a location opposite to the sleeve portion a first inner diameter enabling an outer circumference of the main portion of the rotor to slide therein, and at a location opposite to the main portion of the rotor a second inner diameter larger than the first inner diameter. One end of the pump shaft is journaled in a boss in an inlet of the front casing and the other end of the pump shaft is journaled in a rear wall of the rear casing. With this arrangement, the pump according to the invention is very easy to assemble and disassemble to facilitate its maintenance and inspection of parts.

6 Claims, 6 Drawing Figures

MAGNETIC-DRIVE CENTRIFUGAL PUMP

BACKGROUND OF THE INVENTION

This invention relates to a magnetic-drive centrifugal pump for delivering a fluid under pressure by an impeller driven by a driving motor through a magnetic coupling, and more particularly to a sealless pump which is easy to assemble and disassemble for its maintenance and inspection and superior in chemical corrosion-resistance.

In a magnetic-drive centrifugal pump, a pump rotor and a driving motor are magnetically coupled by a magnetic coupling to transmit rotating torques therebetween, so that a liquid to be delivered does not leak along a pump shaft without using shaft sealing means. Accordingly, such a pump has been widely used for transferring chemical medicines, petroleum and beverages. In this case, the magnetic coupling is accomplished by arranging a driving magnet concentric to and outside an annular impeller magnet provided in an impeller.

Such a magnetic-drive centrifugal pump has a construction as shown in FIG. 1. The pump mainly comprises a pump shaft 1, and an impeller 2 a rotor 3 rotatably mounted through bearings 5 on the pump shaft 1. One end of the pump shaft 1 is journaled its one end in a hub or boss 16 supported by ribs 15 provided in a fluid inlet 13 in a front casing 11 of a pump casing 10 and the other end is journaled in a center of a rear wall of a rear casing 12 accommodating the rotor 3.

In an outer periphery of the rotor 3 is provided a driven or impeller magnet 6 concentric to the pump shaft 1. About an outer periphery of the rear casing 12 a driving magnet 20 concentric to the impeller magnet 6 is provided in a magnet holder 21. The magnet holder 21 is received in a magnet housing 31 and connected to a driving motor 30. A connection between the front casing 11 and the rear casing 12 is sealed by an O-ring 17. The front casing 11 is provided with an outlet 14 for a fluid in a radial direction of blades of the impeller 2. In this manner a pump casing is formed.

With this arrangement of the pump of the prior art, the bearings for the pump shaft 1 are located on an axis of the impeller 2, so that circumferential speeds of the bearings are relatively low. Accordingly, there are advantages in this arrangement in that relatively small bearings can be employed and life spans of the bearings can be elongated, and that the impeller 2 and the rotor 3 having the impeller magnet 6 can be integrally formed.

However, such a pump of the prior art has been used only in relatively low-torque applications, for example, for fluids having small specific gravities or low viscosities because of limited torque which can be transmitted by the magnetic-drive.

In order to solve this problem, it may be considered to use a large impeller magnet or a large rotor. However, the large rotor tends to make difficult the assembling and disassembling of the pump in manufacture it or maintenance and inspection. Such a difficulty is caused by the fact that a pump shaft for supporting the rotor is supported only by a rear wall of a rear casing when the pump is being assembled or disassembled, and the rear wall of the rear casing is subjected to a great moment. In disassembling of the pump, particularly, a great moment is caused by a slight deflection of the pump shaft when its front end is removed from a hub or boss. As a result, such a great moment often damages the pump shaft or the rear casing. When the pump shaft and the rear casing are made of a ceramic material in order to improve their chemical corrosion-resistance, particularly, these members are likely to be damaged because of the brittleness of the ceramic material. To avoid this, it may be considered to enlarge the a diameter of the pump shaft or thickness of the rear wall of the rear casing. However, such an enlargement of the members does not serve to improve a performance of the pump but only makes the pump bulky.

SUMMARY OF THE INVENTION

It is an object of the invention to provide an improved magnetic-drive centrifugal pump having a high performance.

It is another object of the invention to provide a pump which is easy to assembly, disassemble and inspect.

It is a further object of the invention to provide a pump which is superior in chemical corrosion-resistance.

To achieve these objects, in a magnetic-drive centrifugal pump including a driving motor, pump means having a rotor and a magnetic coupling consisting of a driving magnet provided on a magnet holder connected to said driving motor and an impeller magnet provided in said rotor to be magnetically coupled to said driving magnet, according to the invention said pump means comprises a pump shaft, an impeller, said rotor and a sleeve having an outer diameter smaller than an outer diameter of the rotor and connecting said impeller and said rotor, said impeller, said rotor and said sleeve being rotatably mounted on said pump shaft; and a pump casing consisting of a front casing surrounding said impeller and a rear casing surrounding a rear surface of the impeller and said rotor; said rear casing having at a location oppose to said sleeve an inner diameter enabling an outer circumference of said rotor to slide therein, and at a location opposite to said rotor an inner diameter larger than an outer diameter of the rotor; and one end of said pump shaft being journaled in a boss having ribs provided in an inlet of said front casing and the other end of said pump shaft being journaled in a rear wall of said rear casing.

The magnet holder preferably comprises position adjusting means for moving the magnet holder and magnetically coupled rotor toward the front casing.

The rear casing is preferably made of a ceramic material, particularly zirconia ceramics.

In order that the invention may be more clearly understood, preferred embodiments will be described, by way of example, with reference to the accompanying drawings.

DESCRIPTION OF THE PREFERRED EMBODIMENT

Figure 1:
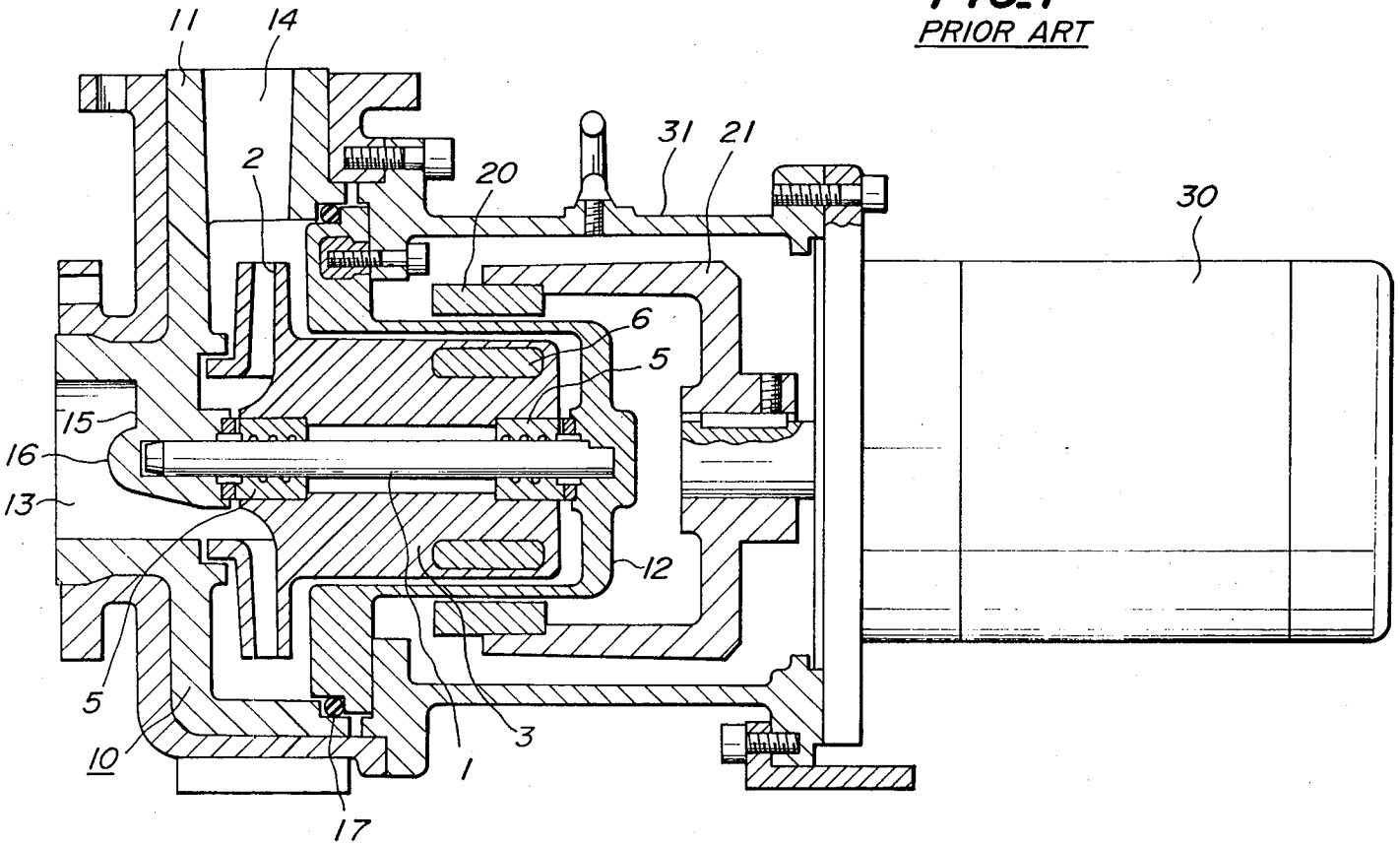
FIG. 1 PRIOR ART
FIG. 1 is a sectional view of a magnetic-drive centrifugal pump of the prior art.
Figure 2:
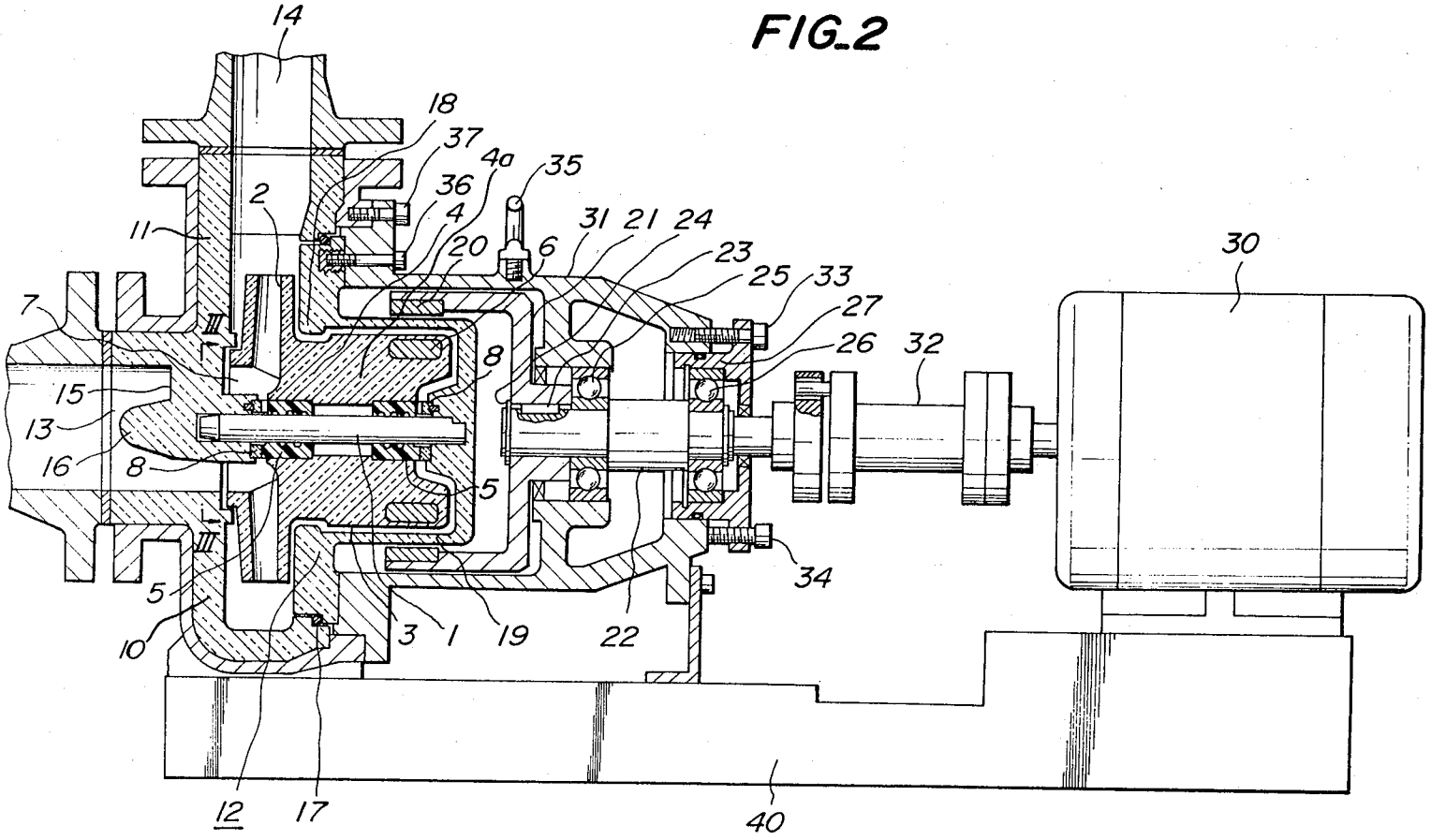
FIG. 2 is a sectional view of one embodiment of the magnetic-drive centrifugal pump according to the invention.

Referring to FIG. 2 illustrating one embodiment of the invention, on a bed 40 are provided a driving motor 30, a magnet housing 31 and a pump casing 10. Between the driving motor 30 and a magnet holder 21 centrally provided in the magnet housing 31 is provided an adaptor 32 connected to a driving shaft 22 of the magnet holder 21 by a flexible coupling. Although the motor 30 is an electric motor in this embodiment, this is only by way of example, and for example, an internal combustion engine may be used for this purpose.

The magnet holder 21 housed in the magnet housing 31 is provided at its end with a driving magnet 20 concentric to the driving shaft 22 and is fixed onto the driving shaft 22 by means of a key 23 and a snap ring 24. The driving shaft 22 is journaled by ball bearings 25 and 26 on sides of the magnet holder 21 and the adaptor 32 respectively. The ball bearing 25 is located between the magnet housing 31 and the driving shaft 22 and rotatable together with the magnet housing 31. On the other hand, the ball bearing 26 is accommodated in a bearing case 27 slidably fitted in the magnet housing 31.

The bearing case 27 is provided at its periphery with bolts 33 and 34 for adjusting the position of the driving magnet 20. The bolt 33 serves to move the magnet holder 21 or driving shaft 22 toward the pump casing 10, while the bolt 34 is fixed to or abuts against an end surface of the housing 31 to support the bearing case 27.

The magnet housing 31 is provided with a hook on the outer periphery on an upper side or opposite to the bed 40 for facilitating assembling and disassembling the pump.

In the pump casing 10, are provided a pump shaft 1, a rotor 3, and an impeller 2. The rotor 3 includes a main portion 4a and a sleeve portion 4 to which is connected the impeller 2. In an outer periphery of the rotor 3 is provided a driven magnet or impeller magnet 6 concentric to the pump shaft 1 so as to couple the driving magnet 20 magnetically. These magnets 20 and 6 are made of a metal or Ferrite having a large coercive force and a large residual flux density. In this embodiment, the impeller magnet 6 is embedded in the rotor 3. However, the impeller magnet 6 may be covered by a material such as polytetrafluoroethylene separate from the material of the rotor 3.

An outer diameter of the sleeve portion 4 is smaller than an outer diameter of the rotor 3. It is preferable to make the impeller 2, the main portion 4a of rotor 3 and the sleeve portion 4 in a unitary body by a ceramic material superior in chemical-corrosion resistance and mechanical strength, such as alumina, zirconia, mullite, silicon carbide, and silicon nitride.

The impeller 2 and the rotor 3 are mounted rotatably on the pump shaft 1 by means of bearings 5. The bearings 5 are formed with spiral grooves in their inner bearing surfaces for circulating a lubricating fluid between the pump shaft 1 and the bearings 5. In view of lubrication, the bearings 5 may be made of graphite, silicon carbide or Teflon.

Figure 3:
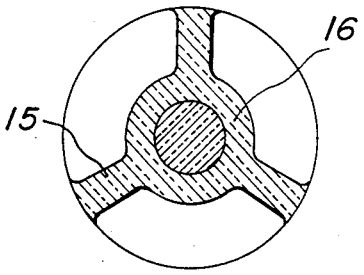
FIG. 3 is a sectional view taken along a line III—III in FIG. 2.

The pump shaft 1 is journaled at its one end in a hub or boss 16 provided in a suction portion 13 in a front casing 11 and at the other end in a rear wall of a rear casing 12 with the aid of the respective thrust washers 8. The boss 16 is supported by ribs 15 provided in an inlet 13 as shown in FIG. 3.

The front casing 11 forms a pump chamber 7 enclosing the impeller 2 and further forms an outlet 14 and the inlet 13 communicating with the pump chamber 7. The front casing 11 is made of an acid-resistant alumina series ceramic material of corrosion-resistance, because it is not required to have a high mechanical strength as required in the rotor 3 and the rear casing 12.

The rear casing 12 consists of a flange portion 18 surrounding the impeller 2, a sidewall 19 surrounding the main portion 4a of rotor 3 and a rear wall. The sidewall 19 serves as a partition between the driving magnet 20 and the impeller magnet 6 and is thinner than the flange portion 18 in order to facilitate the formation of a magnetic field between the driving and impeller magnets 20 and 6.

The flange portion 18 is relatively thick for the purpose of insuring the strength of the rear casing 12 as a whole and enlarging an area for supporting the rotor 3 as explained later. An inner diameter of the sidewall 19 is larger than the outer diameter of the main portion 4a of rotor 3, so that the rotor 3 is rotatable in the rear casing 12 by the magnetic coupling action of the magnets 20 and 6. The flange portion 18 surrounds the impeller 2 and further surrounds an outer periphery of the sleeve portion 4. An inner diameter of the flange portion 18 is equal to or more than the outer diameter of the main portion 4a of rotor 3 so as to permit the rotor 3 to be slidable and insertable into the flange portion 18. A clearance between the flange portion 18 and the sleeve portion 4 serves to cause the lubricating fluid from the pump chamber 7 to return into the bearings 5. An O-ring 17 provided on an outer periphery of the flange portion 18 seals the rear casing 12 from the front casing 11. The flange portion 18 and the magnet housing 31 are fixed to each other by bolts 36, while the front casing 11 and the magnet housing 31 are fixed to each other by bolts 37.

A center portion of the rear wall of the rear casing 12 is formed thicker for supporting the pump shaft 1 and the remaining portion of the rear casing 12 is thicker than the sidewall 19 so as to insure the strength of the rear casing 12. The rear casing 12 may be made of a chemical corrosion-resistant ceramic material such as alumina zirconia, silicon carbide, silicon nitride, sialon or the like. Particularly, a partially stabilized zirconia ceramic (referred to hereinafter as "PSZ") is preferable for the rear casing 12 because of its high mechanical strength and high thermal shock-resistance. When the rear casing 12 is made of such a non-magnetic and electric insulating ceramic material, the sidewall 19 as a partition of the magnetic coupling is also made of such a ceramic material, with the result that the magnetic coupling between the driving and impeller magnets 20 and 6 is improved. In case of the use of the PSZ, the sidewall can be made thinner to cause larger torques which enable the pressure of the pump to be higher. For example, when a thickness of the sidewall made of the PSZ is 5 mm, the pressure of the pump can be 180 $kg/cm^2$.

Figure 4:
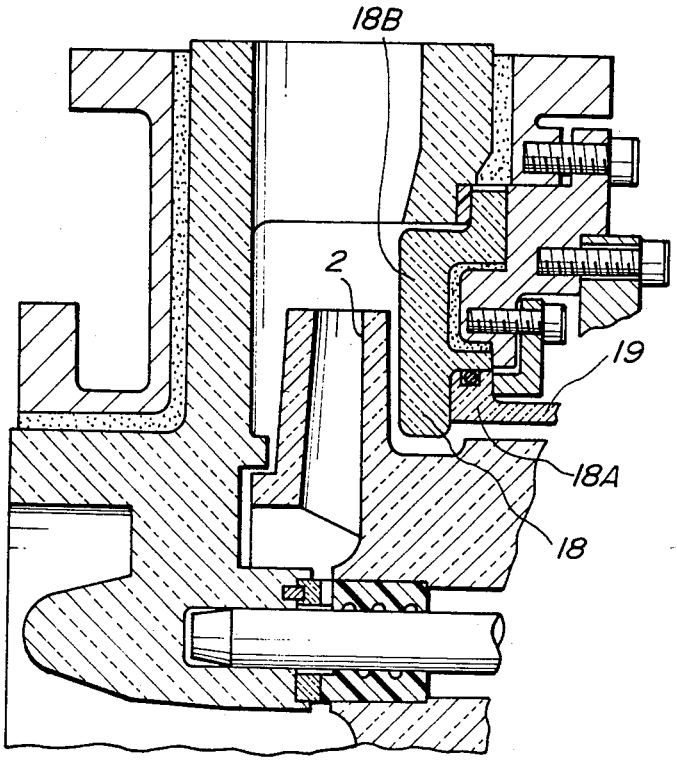
FIG. 4 is a sectional view of a main part of a pump of another embodiment of the invention.

As shown in FIG. 4, the flange portion 18 of the rear casing 12 may consist of a flange 18A integrally formed with the sidewall 19 and a flange 18B surrounding the impeller 2. With this arrangement, the flange 18A is made of the PSZ, while the bulky and complicated flange 18B is made of a ceramic material easy to manufacture, for example, an acid-resistance alumina series ceramic material.

Although the pump casing 10, the impeller 2 and the rotor 3 have been explained to be preferably made of ceramic materials in view of the acid-resistance and mechanical strength, the invention is not limited to such materials and metals or metals with plastic liners may be used according to fluids to be treated.

Figure 5:
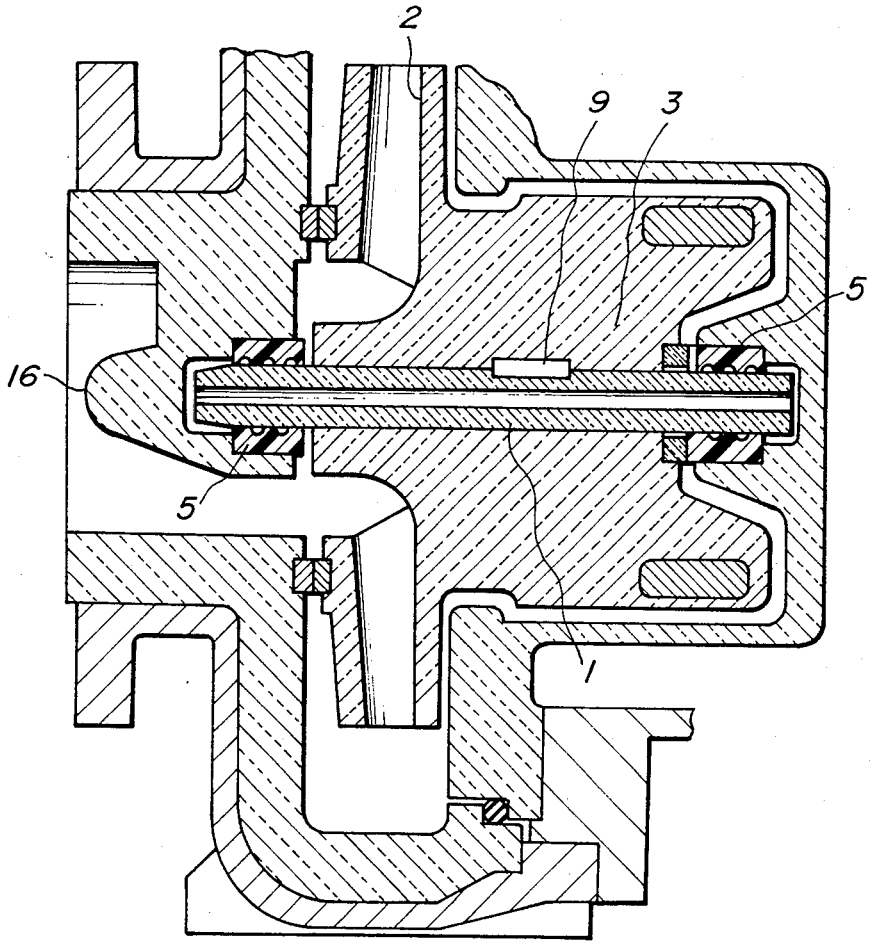
FIG. 5 is a sectional view of a main part of a pump of a further embodiment of the invention.

The impeller 2 and the rotor 3 are rotatable relative to the pump shaft 1 in the embodiment shown in FIG. 2. However, the impeller 2 and the rotor 3 may be fixed to the pump shaft 1 which is rotatable relative to the pump casing 10 as shown in FIG. 5. For this purpose, the rotor 3 is fixed to the pump shaft 1 by means of a key 9 and the pump shaft 1 is journaled by bearings 5 arranged in a boss 16 and in a rear wall of a rear casing 12.

Figure 6:
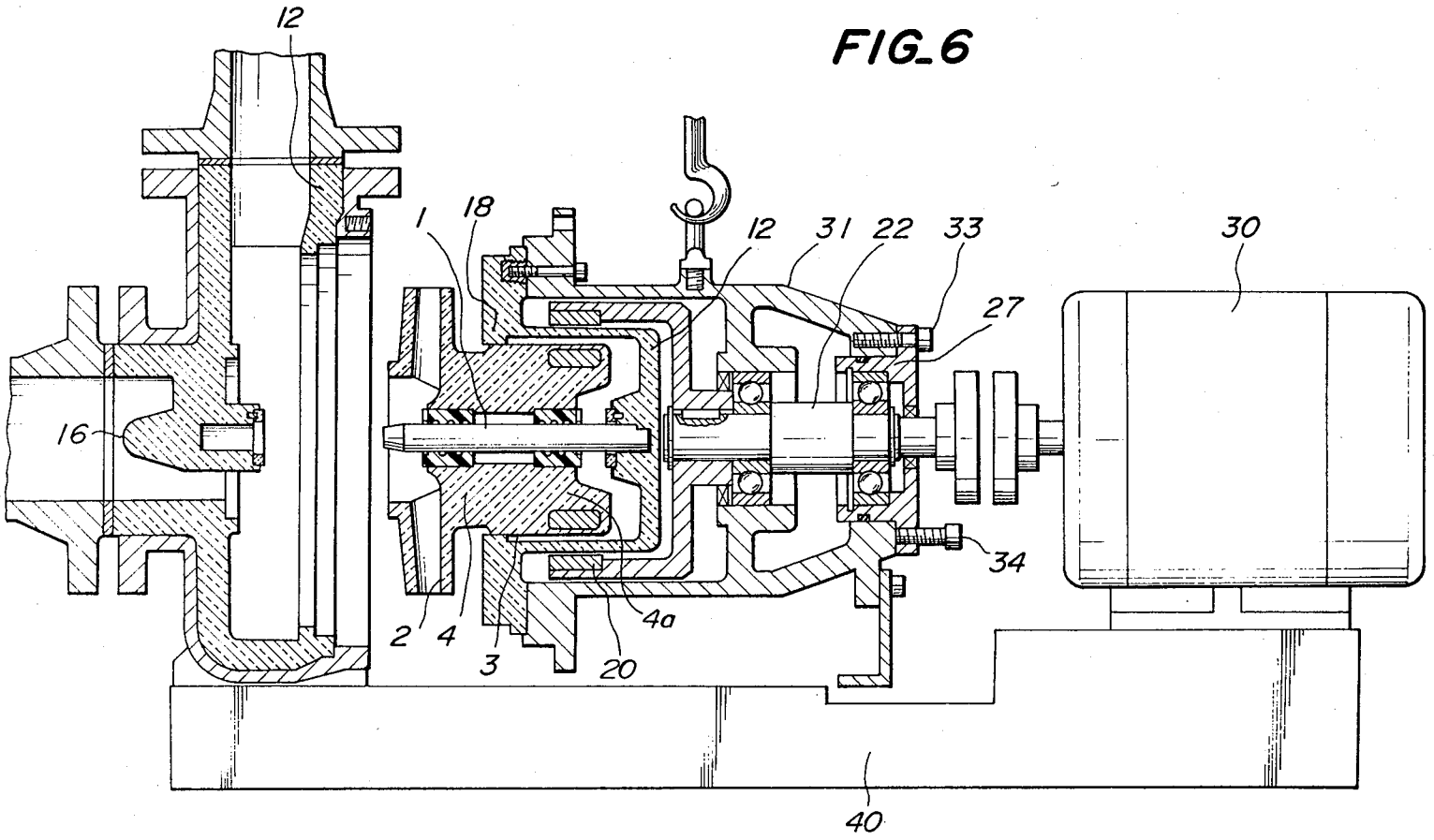
FIG. 6 is a sectional view of the pump shown in FIG. 2 for explaining the disassembling operation of the pump.

Disassembly of the magnetic-drive centrifugal pump according to the invention for maintenance and inspection will be explained with reference to FIGS. 2 and 6 hereinafter.

First, the adaptor 32 is removed from the driving motor 30 and the driving shaft 22. The bolt 34 is then loosened in a direction in which the bearing case 27 is removed, while the bolt 33 is tightened to move the driving shaft 22 toward the rear casing 12. Separate from the removal of the driving shaft 22, the bolts 37 for fixing the magnet housing 31 to the pump casing 10 are removed to bring the magnet housing 31 into a movable condition. Then, the magnet housing 31 is moved toward the driving motor 30 so as to move the pump shaft 1 from the boss 16 to an extent that the pump shaft 1 is still supported in the boss 16.

The movement of the driving shaft 22 results in a movement of the driving magnet 20, so that the rotor 3 provided with the impeller magnet 6 magnetically coupled with the driving magnet 20 is slid on the pump shaft 1 toward the front casing 11 so as to cause the outer circumference of the main portion 4*a* of rotor 3 to be opposite the flange portion 18 of the rear casing 12.

Then, the magnet housing 31 including the rotor 3 is moved toward the driving motor 30 to remove the pump shaft 1 from the boss 16 of the front casing 11.

By the above successive operations, the front casing 11 is removed from the rotor 3 and the rear casing 12. In this removing operation, the rotor 3 is supported by the flange portion 18, so that the rotor 3 does not apply any off-set stress to the pump shaft 1 and inner surfaces of the rear casing 12.

In order to separate the rotor 3 from the rear casing 12, the rotor 3 is slid on the inner circumferential surface of the flange portion 18 of the rear casing 12 to remove the rotor 3 out of the rear casing 12 together with the impeller 2.

After the magnetic-drive centrifugal pump has been disassembled in this manner, respective parts are cleaned for maintenance and inspected concerning for example wearing of the bearings and damaged conditions of the impeller.

An assembling operation of the pump will not be described since the assembling can be effected in reverse steps to those of the disassembling above described.

As can be seen from the above description, the magnetic-drive centrifugal pump is easy to assemble and disassemble and can employ a large pump rotor to improve the performance of this pump without any trouble even if the weight of the rotor is increased, so that the pump is applicable to fluids of large specific gravities and high viscosities.

It is further understood by those skilled in the art that the foregoing description is that of preferred embodiments of the disclosed pumps and that various changes and modifications may be made in the invention without departing from the spirit and scope thereof.

What is claimed is:

1. A magnetic-drive centrifugal pump including a driving motor, pump means having a rotor and a magnetic coupling consisting of a driving magnet provided on a magnet holder connected to said driving motor and an impeller magnet provided in said rotor to be magnetically coupled to said driving magnet, wherein said pump means further comprises:

a pump shaft;

an impeller;

a rotor sleeve portion between the impeller and a main portion of the rotor and having the impeller connected thereto, said sleeve portion having an outer diameter smaller than an outer diameter of the main protion of the rotor, said impeller, said main portion of said rotor and said sleeve portion being rotatably mounted on said pump shaft;

a pump casing consisting of a front casing surrounding said impeller and a rear casing surrounding a rear surface of the impeller and said sleeve portion and main portion of said rotor;

said rear casing having at a location opposite said sleeve portion a first inner diameter which is large enough to enable an outer circumference of said main portion of said rotor to slide therein, and at a location opposite said main portion of said rotor a second inner diameter larger than said first inner diameter; and one end of said pump shaft being journaled in a boss having ribs provided in an inlet of said front casing, and the other end of said pump shaft being journaled in a rear wall of said rear casing;

whereby the rotor is adequately supported by the rear casing during disassembly so as to avoid application of off-set stresses to the pump shaft and inner surfaces of the rear casing.

2. A magnetic-drive centrifugal pump as set forth in claim 1, wherein said magnet holder comprises position adjusting means for moving said magnet holder and said magnetically coupled rotor toward said front casing during disassembly.

3. A magnetic-drive centrifugal pump as set forth in claim 2, wherein said position adjusting means comprises a bearing case mounted through a bearing on a driving shaft of said magnet holder, and a position adjusting bolt provided between said bearing case and the magnet housing accommodating said magnet holder.

4. A magnetic-drive centrifugal pump as set forth in claim 1, wherein said rear casing is made of a ceramic material.

5. A magnetic-drive centrifugal pump as set forth in claim 4, wherein said ceramic material is zirconia ceramic.

6. A magnetic-drive centrifugal pump as set forth in claim 4, wherein a thickness of said rear casing between the driving and impeller magnets is thinner than a thickness of that portion of said rear casing which surrounds said rear surface of the impeller and said sleeve.

* * * * *